US008276278B2

(12) United States Patent
Makoto

(10) Patent No.: US 8,276,278 B2
(45) Date of Patent: Oct. 2, 2012

(54) HAIRDRESSING SCISSORS

(76) Inventor: Hasegawa Makoto, Sanjyou (JP)

( * ) Notice: Subject to any disclaimer, the term of this patent is extended or adjusted under 35 U.S.C. 154(b) by 452 days.

(21) Appl. No.: 12/263,500

(22) Filed: Nov. 2, 2008

(65) Prior Publication Data

US 2010/0107420 A1 May 6, 2010

(51) Int. Cl.
*B26B 19/22* (2006.01)

(52) U.S. Cl. ..... 30/194; 30/195; 30/201; 30/244; 30/252

(58) Field of Classification Search ..... 30/201, 30/196, 211, 254, 252, 244, 266, 270, 260, 30/194, 195; 7/135, 139, 131
See application file for complete search history.

(56) References Cited

U.S. PATENT DOCUMENTS

| | | | | | |
|---|---|---|---|---|---|
| 252,248 | A * | 1/1882 | Pease | 81/394 |
| 751,202 | A * | 2/1904 | Porter | 30/193 |
| 964,532 | A * | 7/1910 | McAslan | 7/131 |
| 1,886,273 | A * | 11/1932 | Thomson | 30/266 |
| 2,000,852 | A * | 5/1935 | Langbein | 30/230 |
| 2,395,897 | A * | 3/1946 | Ketheart | 30/230 |
| 2,436,560 | A * | 2/1948 | Feather | 30/266 |
| 3,336,668 | A * | 8/1967 | Groom | 30/239 |
| 3,460,251 | A * | 8/1969 | Kraty et al. | 30/248 |
| 3,609,863 | A * | 10/1971 | Woodward | 30/266 |
| 5,628,116 | A * | 5/1997 | Kohno | 30/267 |
| 6,131,291 | A * | 10/2000 | Mock | 30/266 |
| 6,904,685 | B1 * | 6/2005 | Yeh | 30/254 |

* cited by examiner

*Primary Examiner* — Boyer D Ashley
*Assistant Examiner* — Omar Flores Sanchez

(57) ABSTRACT

A pair of hairdressing scissors capable of adjusting the amount of hair cut comprises a first blade, a second blade and an adjustment member. The adjustment member is pivotally mounted on the first blade. The second blade is eccentrically pivoted on the adjustment member. The adjustment member can be rotated to change the relative position and the contact area between the two blades, thus changing the amount of hair cut.

2 Claims, 8 Drawing Sheets

HAIRDRESSING SCISSORS

BACKGROUND OF THE INVENTION

1. Field of the Invention

The present invention relates to a trimming tool having a plurality of cutting edges, and more particularly to a pair of hairdressing scissors capable of adjusting the amount of hair cut.

2. Description of the Prior Art

Hair trimming is conventionally performed by dividing a handful of hair into several small handfuls of hair for respective trimming, which is called as thinning technique. Thus the conventional hair trimming is time-consuming and quite troublesome.

In order to solve the above problem, a conventional pair of hairdressing scissors was developed on the market. It has two blades, which are pivoted to each other in a stagger manner to form an X-shape. Each blade includes a plurality of spaced cutting edges. The respective cutting edges of one blade are aligned with the respective cutting edges of the other blade after the two blades are pivoted to each other. The cutting edges of the two blades can cut the hair during hair cutting. The gaps between the cutting edges are provided for accommodating hair in such a manner that some hair can be left while some hair is cut down during hair trimming, simply achieving the thinning effect.

However, in order to shape various hairstyles, a real professional hairstylist certainly will prepare numerous pairs of hairdressing scissors with different cutting capabilities. Even sometimes, in order to trim a small portion, plural pairs of hairdressing scissors with different cutting capabilities are required, and this causes much inconvenience to the hairstylist. The present invention has arisen to mitigate and/or obviate the afore-described disadvantages.

SUMMARY OF THE INVENTION

The primary objective of the present invention is to provide a pair of hairdressing scissors, which can change the amount of hair cut by changing the relative position between the blades.

In order to achieve the above objective, the pair of hairdressing scissors of the present invention comprises a first blade, a second blade and an adjustment member. The adjustment member is pivotally mounted on the first blade and has an axis. The second blade is eccentrically pivoted to adjustment member relative to the axis in such a manner that the two blades are pivoted to each other to form an X-shape by the adjustment member.

By rotating the adjustment member, the second blade can be linked to move around the axis, so that the relative position between the first blade and the second blade can be changed, thus changing the amount of hair cut.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
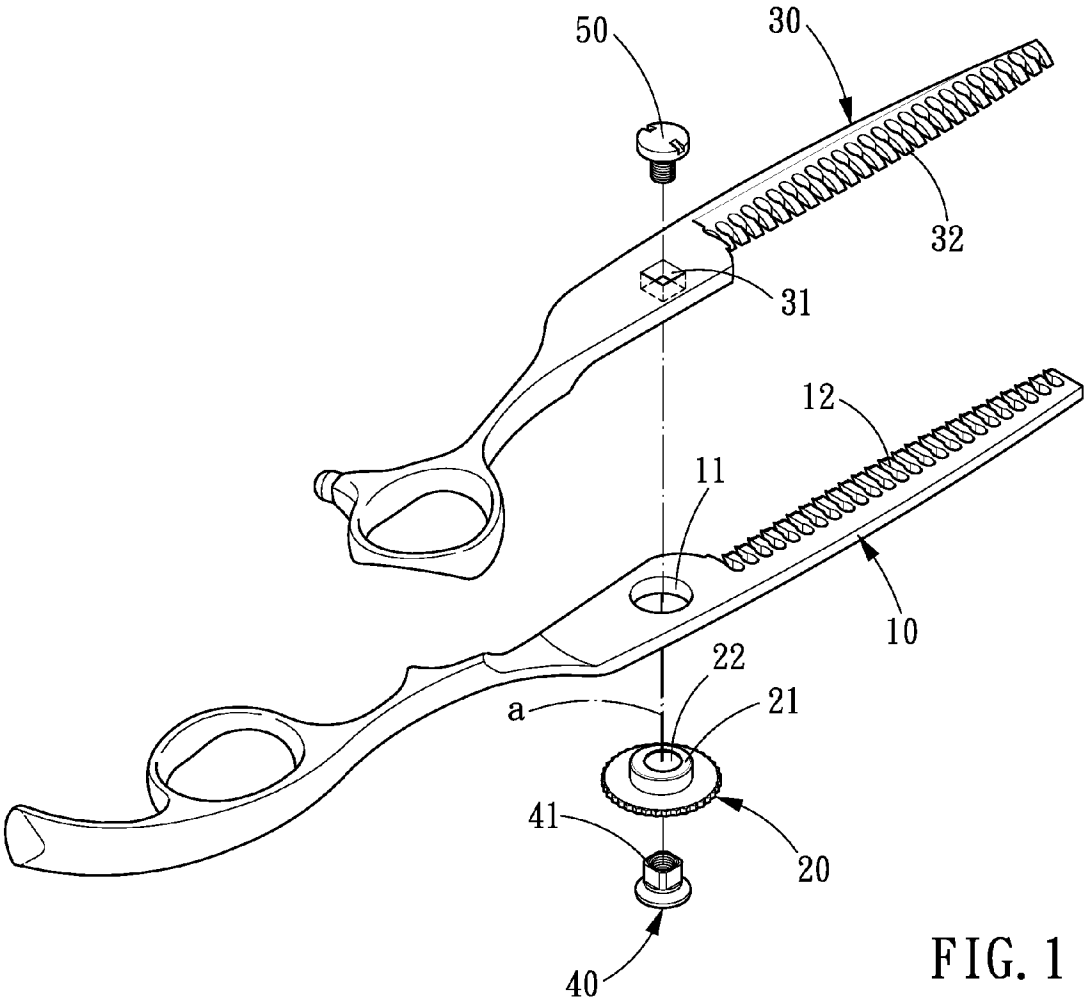
FIG. 1 is an exploded view of a pair of hairdressing scissors in accordance with the present invention.
Figure 2:
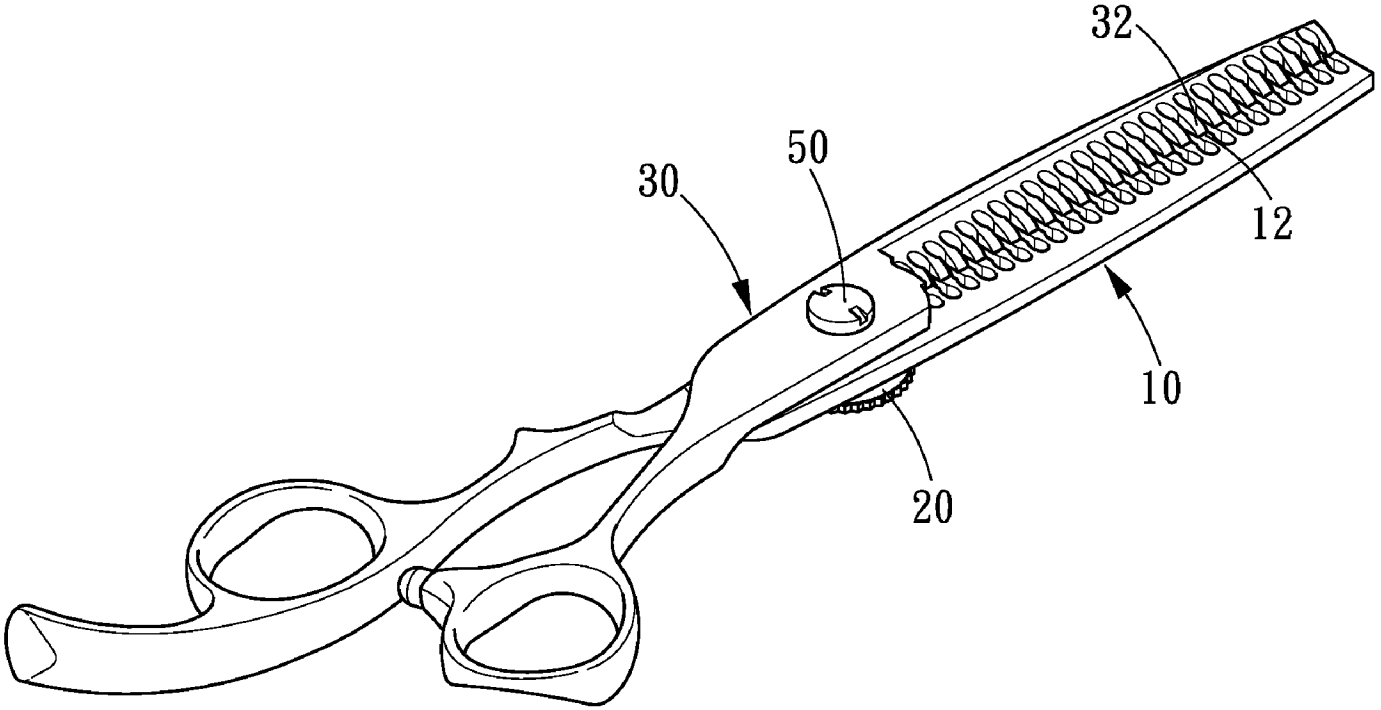
FIG. 2 is a perspective view of the pair of hairdressing scissors in accordance with the present invention.
Figure 3:
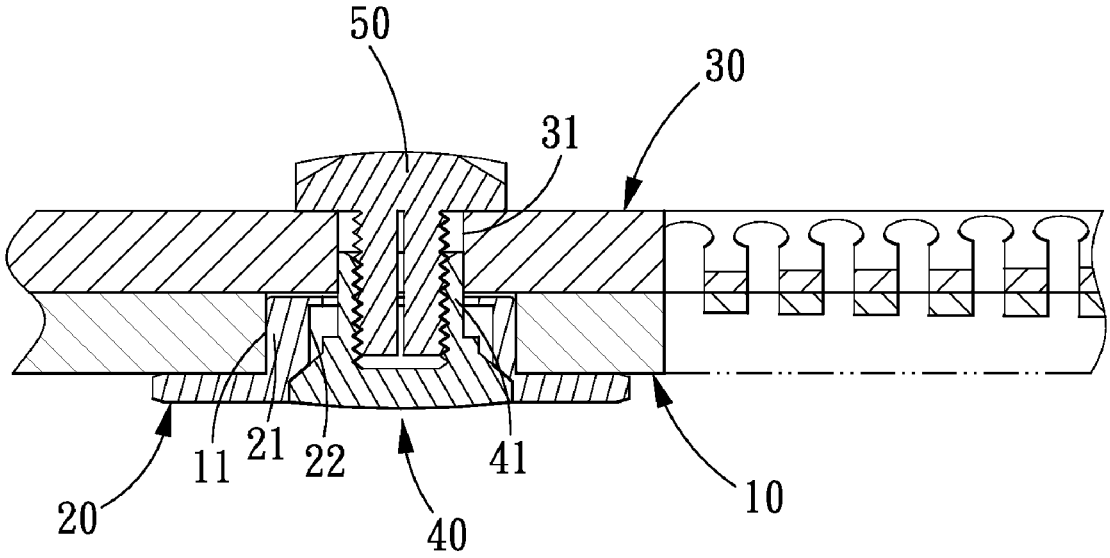
FIG. 3 is a cross-sectional of the pair of hairdressing scissors in accordance with the present invention.

Referring to FIGS. 1-3, a pair of hairdressing scissors capable of adjusting the amount of hair cut in accordance with the present invention comprises:

A first blade 10 includes a round through hole 11 and a plurality of spaced cutting edges 12 that are continuously arranged. Between the respective cutting edges 12 is defined a gap.

An adjustment member 20 includes a round protruding pivoting pillar 21 to be inserted into the through hole 11 of the first blade 10, the adjustment member 20 can be pivoted relative to the first blade 10 around an axis a of the pivoting pillar 20, and the pivoting pillar 21 is an eccentric structure and formed with an eccentric hole 22 aligned with the axis a. When the adjustment member 20 rotates relative to the first blade 10, the eccentric hole 22 can move around the axis a.

A second blade 30 includes a through hole 31 and a plurality of spaced cutting edges 32 that are continuously arranged. Between the respective cutting edges 12 is defined a gap. One end 41 of a pivoting member 40 is sequentially inserted through the eccentric hole 22 of the adjustment member 20 and the though hole 31 of the second blade (in the present embodiment, the through hole of the second blade is square, and the pivoting member is formed with a similar structure to mate with the through hole of the second blade, further, the through hole of the second blade can also be round, triangular, pentagonal, etc.). In addition, a locking member 50 is assembled to the end 41 of the pivoting member 40 (in the present embodiment, the end of the pivoting member includes inner threads, the locking member includes outer threads, so that the locking member utilizes its outer threads to mate with the inner threads of the end for screwing the pivoting member 40 with the locking member 50), so as to restrict the adjustment member 20, the first blade 10 and the second blade 30 between the pivoting member 40 and the locking member 50 sequentially and enable the two blades 10, 30 to be pivoted to each other to form an X-shape, and the cutting edges 12 of the first blade 10 are aligned with the cutting edges 32 of the second blade, respectively.

When in use, the two blades 10, 30 can pivot relative to each other around the pivoting member 40. During hair cutting, the hair located between the cutting edges 12, 32 can be cut down and the hair located in the gaps between the cutting edges 12, 32 can be left.

It is to be noted that, when the adjustment member 20 is rotated, the eccentric pivoting pillar 21 will also rotate, and the rotation of the pivoting pillar 21 will cause the first blade 10 to move linearly (instead of rotating) with respect to the second blade 30, so that the contact area between the cutting edges 12 of the first blade 10 and the cutting edges 32 of the second blade 30 can be changed.

Figure 4B:
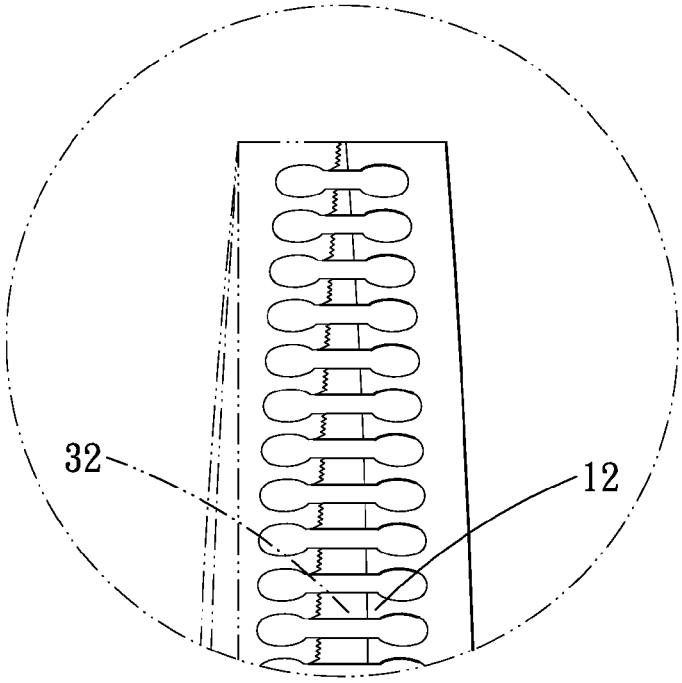
FIG. 4*b* illustrates that the cutting edges of the two blades are fully aligned with each other in accordance with the present invention.
Figure 4A:
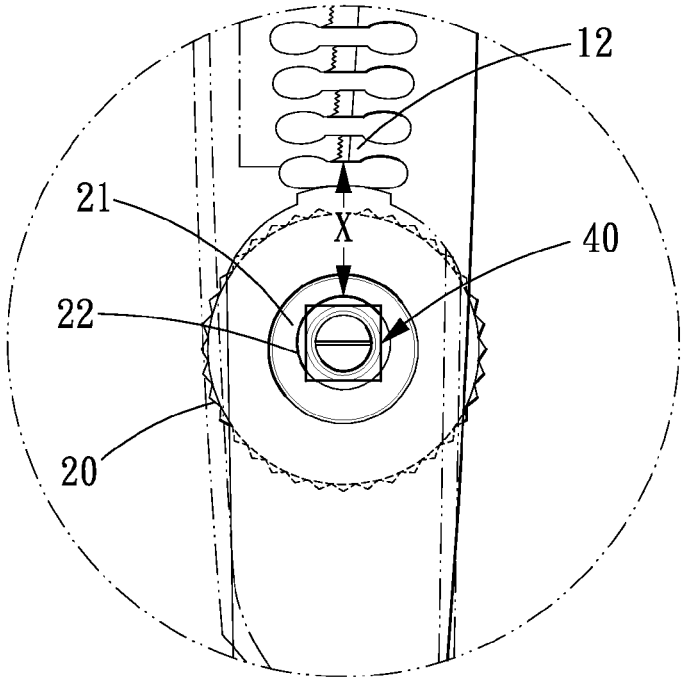
FIG. 4*a* illustrates that the distance between the eccentric hole and the cutting edges of the first blade is the minimum in accordance with the present invention.

Referring to FIG. 4*a*, when the adjustment member 20 rotates to a position where the distance X between the eccentric hole 22 and the cutting edges 12 of the first blade is the minimum, and the cutting edges 12 of the first blade 10 are fully aligned with the corresponding cutting edges 32 of the second blade 30. Thus, at this moment, the amount of hair cut by each snip of the pair of hairdressing scissors is the maximum.

Figure 5B:
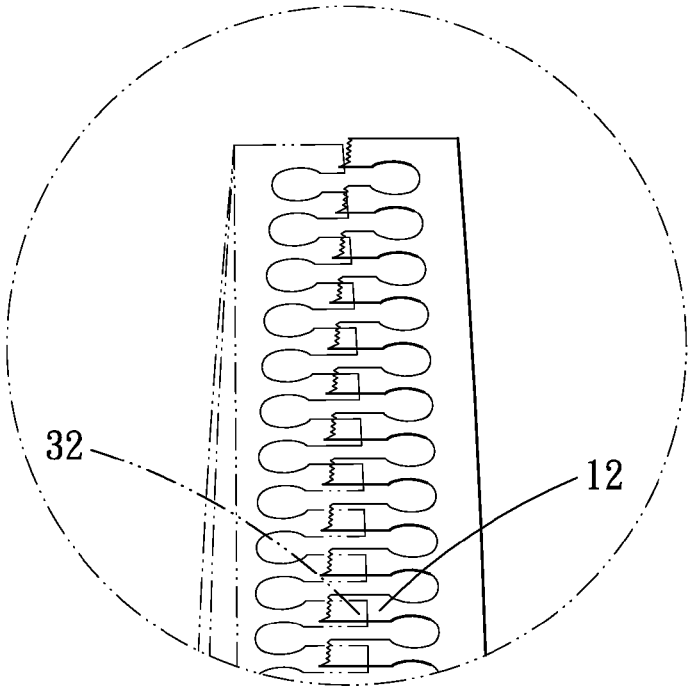
FIG. 5*b* illustrates the contact area between the two blades gradually descends in accordance with the present invention.
Figure 5A:
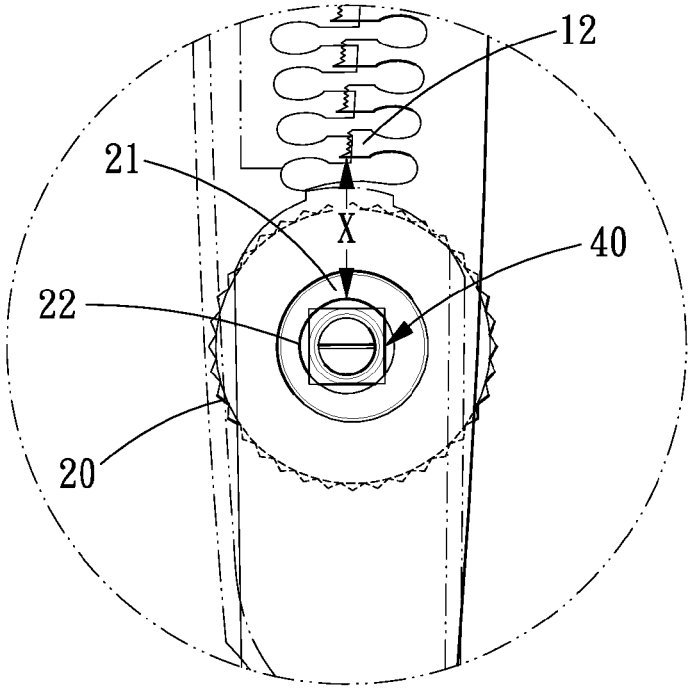
FIG. 5*a* illustrates that the distance between the eccentric hole and the cutting edges of the first blade gradually increases in accordance with the present invention.

As shown in FIG. 5*a*, when the adjustment member 20 is rotated to gradually increase the distance X between the eccentric hole 22 and the cutting edges 12 of the first blade 10, the contact area between the cutting edges 12, 32 of the first blade 10 and the second blade 30 descends gradually as shown in FIG. 5*b*. Thus, the amount of hair cut by each snip of the pair of hairdressing scissors also descends gradually.

Figure 6B:
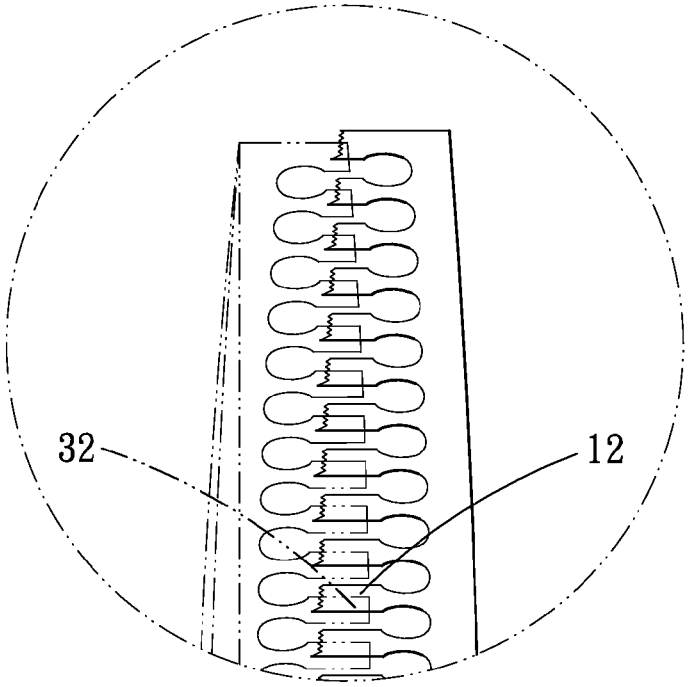
FIG. 6*b* illustrates that the contact area between the two blades is the minimum in accordance with the present invention.
Figure 6A:
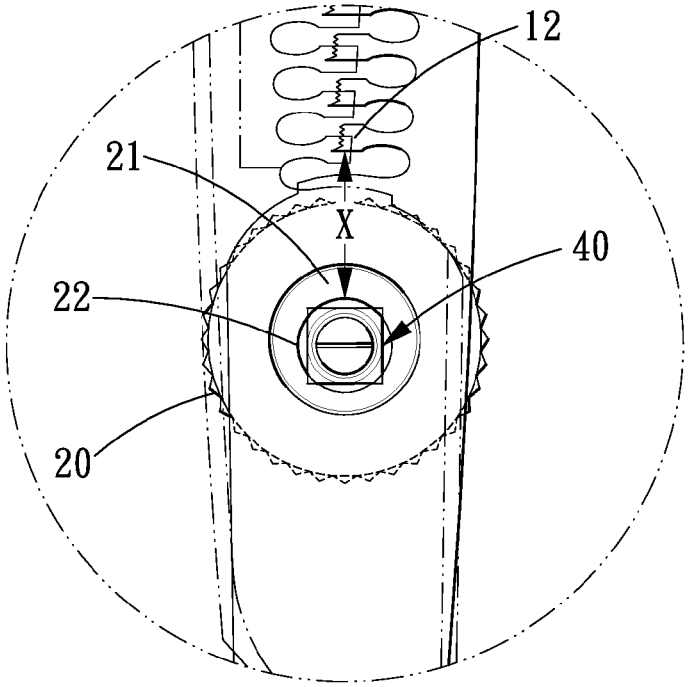
FIG. 6*a* illustrates that the distance between the eccentric hole and the cutting edges of the first blade is the maximum in accordance with the present invention.

As shown in FIG. 6*a*, when the adjustment member 20 is rotated to a position where the distance X between the eccentric hole 22 and the cutting edges 12 of the first blade 10 is the maximum, the contact area between the cutting edges 12, 32 of the first blade 10 and the second blade 30 is the minimum as shown in FIG. 5*b*. Thus, at this moment, the amount of hair cut by each snip of the pair of hairdressing scissors is the minimum.

As known from the above, rotating the adjustment member 20 can change the distance X between the eccentric hole 22 and the cutting edges 12 of the first blade 10, thus changing the contact area between the cutting edges 12, 32 of the first blade 10 and the second blade 30 and changing the amount of hair cut by each snip of the hairdressing scissors. Therefore, the hairstylist doesn't require preparing a plurality pairs of different hairdressing scissors with different cutting capabilities for trimming hair. Hence, the present invention has the advantages: more convenient and time-saving.

Figure 7:
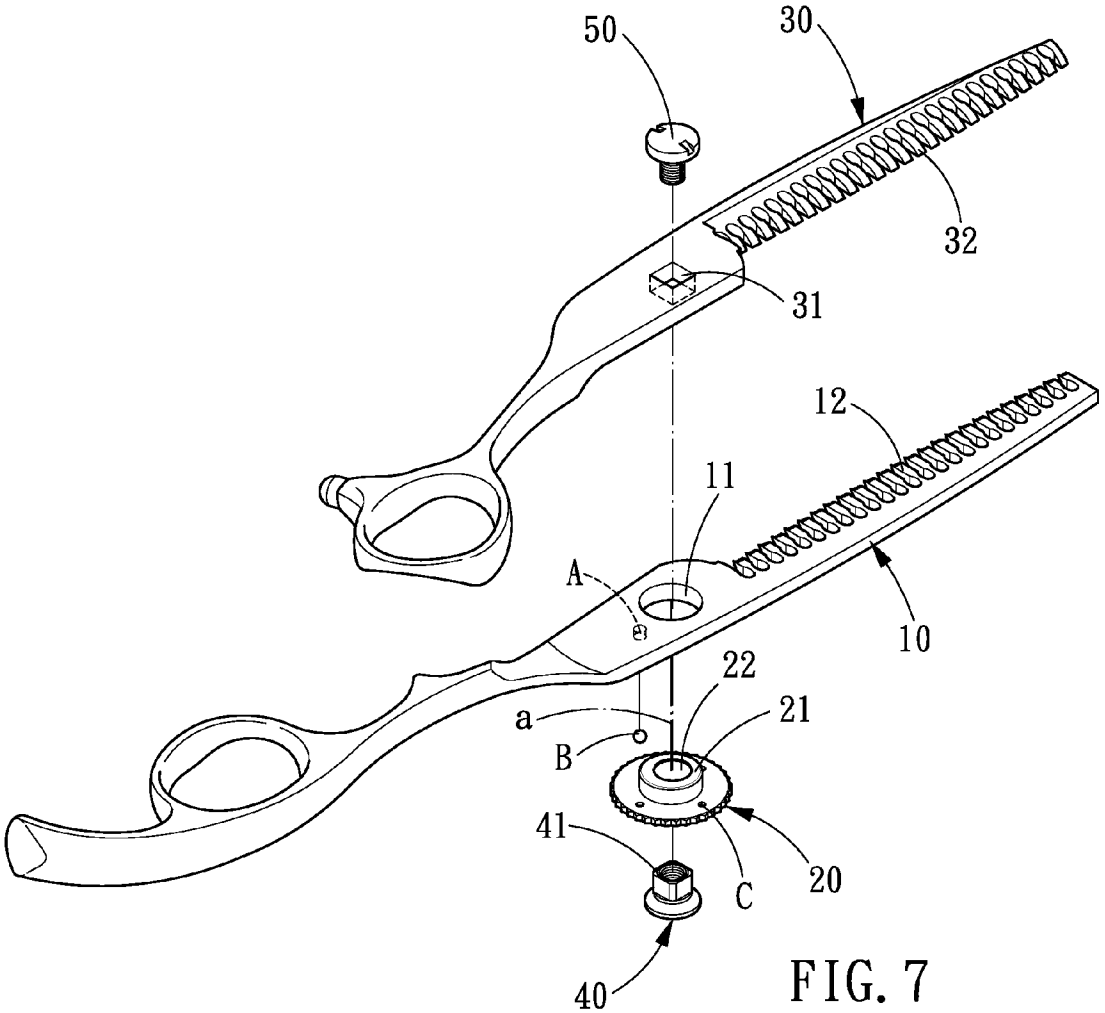
FIG. 7 is an exploded view showing that the first blade is additionally provided with a ball in accordance with the present invention.
Figure 8:
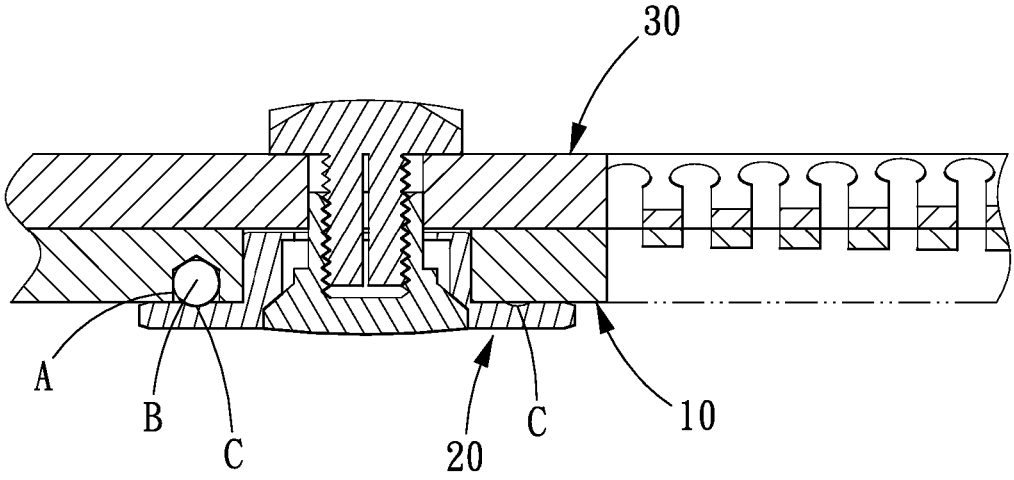
FIG. 8 is a cross-sectional view showing that the first blade is additionally provided with a ball in accordance with the present invention.

Further referring to FIGS. 7-8, the pair of hairdressing scissors can be formed with a cavity A in which a ball B is disposed. The ball B is located between the first blade 10 and the adjustment member 20. The adjustment member 20 is further formed with at least one groove C correspondingly to the ball B. Locating the ball B in one of the grooves C can make the adjustment member 20 get stuck, thus achieving the positioning of the adjustment member 20.

As understood from the above respective embodiments, the central concept of the present invention is that, the two blades are pivotally mounted on an adjustment member, respectively, and the rotating axes of the two blades are different, by such a structure, the objective of changing the amount of hair cut by each snip can be achieved.

While we have shown and described various embodiments in accordance with the present invention, it is clear to those skilled in the art that further embodiments may be made without departing from the scope of the present invention.

What is claimed is:

1. A pair of hairdressing scissors capable of adjusting the amount of hair cut by each snip, comprising:

a first blade including a plurality of cutting edges and a circular through hole;

an adjustment member pivoted in the though hole of the first blade by a pivoting pillar, the pivoting pillar being formed with a hole;

a pivoting member having an end which is square-shaped in cross section;

a second blade including a plurality of cutting edges and a square-shaped through hole, and the end of the pivoting member square-shaped in cross section being inserted through the hole of the pivoting pillar and engaged in the square-shaped through hole of the second blade; and a locking member inserted through the square-shaped through hole of the second blade and screwed with the end of the pivoting member square-shaped in cross section, so that the two blades are pivoted to each other to form an X-shape, and the respective cutting edges of the two blades are aligned with each other;

the hairdressing scissors being characterized in that the pivoting pillar of the adjustment member is an eccentric structure, when the adjustment member is rotated, rotation of the pivoting pillar causes the first blade to move with respect to the second blade, so that a contact area between the two blades is changed, thus changing the amount of hair cut.

2. The pair of hairdressing scissors capable of adjusting the amount of hair cut as claimed in claim 1, wherein the first blade is provided with a ball located between the first blade and the adjustment member, and the adjustment member is provided with at least one groove correspondingly to the ball for retaining the ball.

* * * * *